United States Patent [19]

Montgomery

[11] 4,450,764

[45] May 29, 1984

[54] HIDE PRESS AND METHOD FOR SHIPPING HIDES

[76] Inventor: Preston D. Montgomery, c/o Multiple Systems, Inc., P.O. Box 15025, Amarillo, Tex. 79105

[21] Appl. No.: 412,265

[22] Filed: Aug. 27, 1982

[51] Int. Cl.[3] ..... B30B 9/02

[52] U.S. Cl. ..... 100/37; 69/21; 69/48; 100/127; 100/229 R; 100/248; 100/295; 206/83.5

[58] Field of Search ..... 100/110, 126, 125, 127, 100/128, 129, 37, 51, 116, 221, 224, 229 R, 240, 246, 295, 247, 252, 248, 249; 206/83.5; 69/21, 48

[56] References Cited

U.S. PATENT DOCUMENTS

| | | | |
|---|---|---|---|
| 65,431 | 6/1867 | Ragan | 100/224 |
| 232,619 | 9/1880 | Stevens | 100/125 |
| 1,126,073 | 1/1915 | Peterson et al. | 100/252 X |
| 2,633,062 | 3/1953 | Gaston | 100/37 X |
| 2,782,711 | 2/1957 | Heizer et al. | 100/229 R |
| 3,355,805 | 12/1967 | Krueger et al. | 100/110 X |

FOREIGN PATENT DOCUMENTS

| | | | |
|---|---|---|---|
| 627379 | 9/1961 | Canada | 100/229 R |
| 369378 | 6/1963 | Switzerland | 100/110 |

*Primary Examiner*—Billy J. Wilhite
*Attorney, Agent, or Firm*—Wendell Coffee

[57] ABSTRACT

A frame forms a container having four vertical sides and a flat bottom plate. A hydraulically raised and lowered gate forms one of the sides. Wet hides are stacked on a pallet commonly used with a forklift. The gate is raised, and the loaded pallet placed on the bottom plate. The gate is lowered, and fillers are extended through side openings in the pallet into voids between the pallet top and bottom. A platen above the hides is hydraulically pressed downward within the container to compress the hides. A selected pressure on the hides is maintained for a desired compression period. The fillers within the voids limit deflections of the pallet top during compression of the hides, and consequently prevent damage to the pallet. The fillers are withdrawn, the gate raised, and the loaded pallet removed. The compressed, dry, cohesive hide bundles have a flat top and flat, vertical sides and are more efficiently packed for shipping.

15 Claims, 6 Drawing Figures

HIDE PRESS AND METHOD FOR SHIPPING HIDES

BACKGROUND OF THE INVENTION:

(1.) Field of the Invention

This invention relates to shipment of materials, and more particularly to preparation and shipment of hides.

(2.) Description of the Prior Art

Prior to my invention, referring to FIG. 1, wet hides, and in particular cow hides, were stacked on pallets at the meat packing facility and set aside for a period of time to allow excess water to dry or drain from the hides. The loose, unevenly stacked, partially dried hides were then bound to the pallets with bands for shipment to a tannery. Because the hides on the pallets were uneven, rounded, and irregular, they could not be satisfactorily stacked more than two pallets high and could not be closely packed side by side.

Before this application was filed, a search was made in the U.S. Patent and Trademark Office. That search developed the following U.S. patents:

RAGAN—U.S. Pat. No. 65,431
STEVENS—U.S. Pat. No. 232,619
HEIZER ET AL—U.S. Pat. No. 2,782,711
KRUEGER ET AL—U.S. Pat. No. 3,355,805

These patents are cited only because they were reported, since they do not seem pertinent.

SUMMARY OF THE INVENTION (1.) New and Different Function

In preparing hides for shipment, according to my invention, the hides are stacked on a pallet commonly used with a forklift, and compressed while on the pallet. The resulting improved hide bundle on the pallet is shown in FIG. 2. The compression of the hides rapidly squeezes the liquid from the hides and permits immediate shipment, as opposed to the time consuming drying period previously required. Additionally, the compressed hide bundle is cohesive, and does not require the straps or bands previously used to keep the loose prior art stacks on the pallets. The compressed hides occupy less volume, thereby enabling more hides to be packed on each pallet.

Hides compressed according to my invention, form a cohesive bundle having flat vertical sides and a flat top. This shape facilitates close packing of pallets and bundles side by side and three or more bundles high, thereby greatly increasing the number of hides that can be stored or shipped within a given volume.

My invention also permits the use of wood pallets commonly used in the meat packing industry, despite the substantial forces required to compress the hides. Damage to the wood pallets during compression is prevented by fillers extending through side openings in the pallets to fill voids between the runners thereof. The fillers support the pallet top during compression operations.

Thus it may be seen that the function of the total combination far exceeds the sum of the functions of the individual elements, such as pallets, plates, hydraulic cylinders, stanchions, etc.

(2.) Objects of this Invention

An object of this invention is to efficiently ship hides.

Another object of this invention is to efficiently store hides prior to and after shipment.

Further objects are to achieve the above with a device that is sturdy, compact, durable, lightweight, simple, safe, efficient, versatile, ecologically compatible, energy conserving, and reliable, yet inexpensive and easy to manufacture, install, adjust, operate and maintain.

Other objects are to achieve the above with a method that is versatile, ecologically compatible, energy conserving, rapid, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not scale drawings

Figure 1:
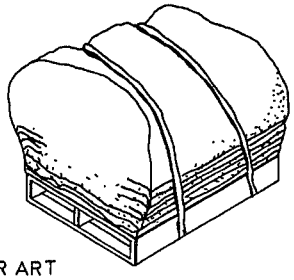
FIG. 1 is a perspective view of a bundle of hides on a pallet according to the prior art.
Figure 2:
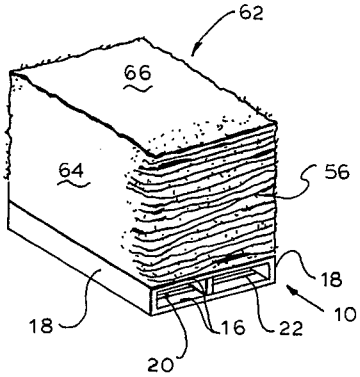
FIG. 2 is a perspective view of a bundle of hides on a pallet according to my invention.

DESCRIPTION OF THE PREFERRED EMBODIMENT:

The drawings disclose prior art pallet 10 of a type commonly used in commerce to move, ship and store materials thereon. The pallet 10 has flat pallet top 12 and flat pallet bottom 14, each formed by a plurality of coplanar, spaced apart slats 16. The pallet top 12 and bottom 14 are spaced apart by spacer structure in the form of three, parallel spaced apart runners 18 perpendicular to the slats 16.

The runners 18, pallet top 12 and pallet bottom 14 create voids 20 between the runners 18, and opposing side openings 22 and 22' at the ends of each pair of the runners 18. The pallets 10 are commonly made of wood slats 16 nailed to wood runners 18.

The pallet 10 is ordinarily moved from place to place by inserting the forks of a forklift truck into the voids 20 through the side opening 22 or 22', lifting the pallet with the forks under the top 12, transporting the pallet to another location, lowering the pallet 10 onto a floor or other flat supporting surface, and withdrawing the forks from the voids 20. My invention facilitates the use of the affordable, easily constructed, and commonly available wooden pallets 10. However, my invention may employ other types of pallets if they have a top and bottom with voids therebetween that are accessible through side openings.

Figure 4:
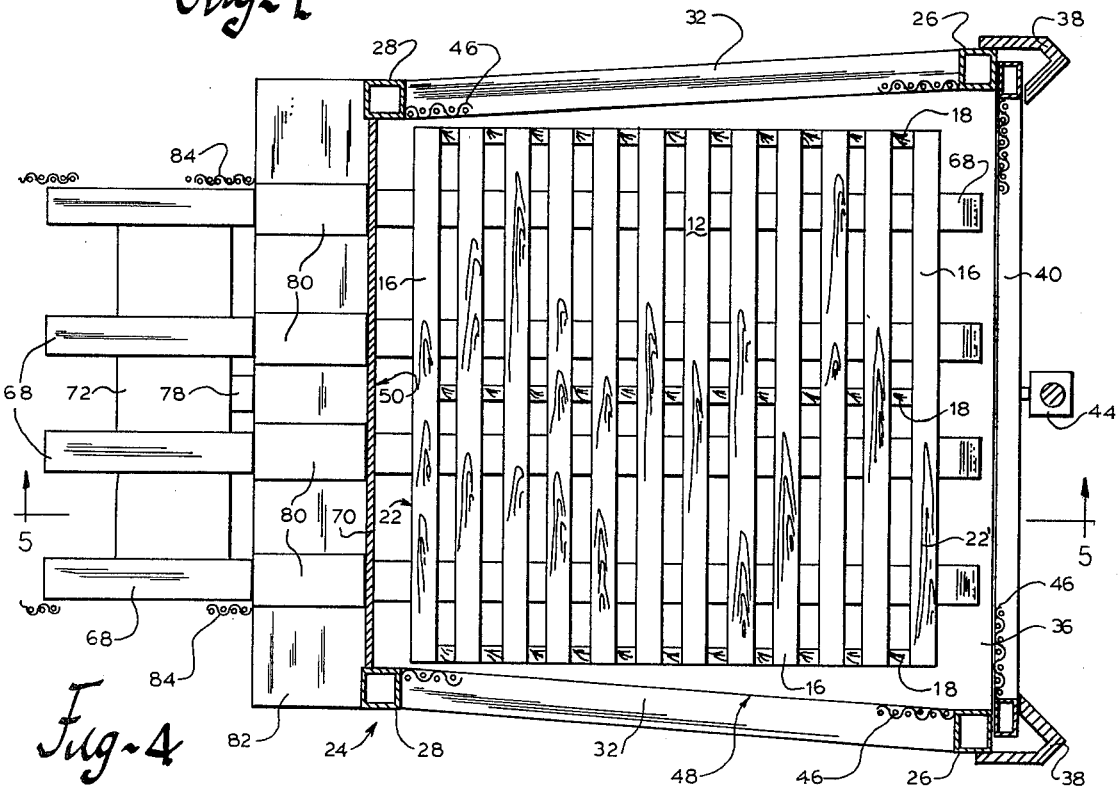
FIG. 4 is a top section view taken substantially on line 4—4 of FIG. 3.
Figure 5:
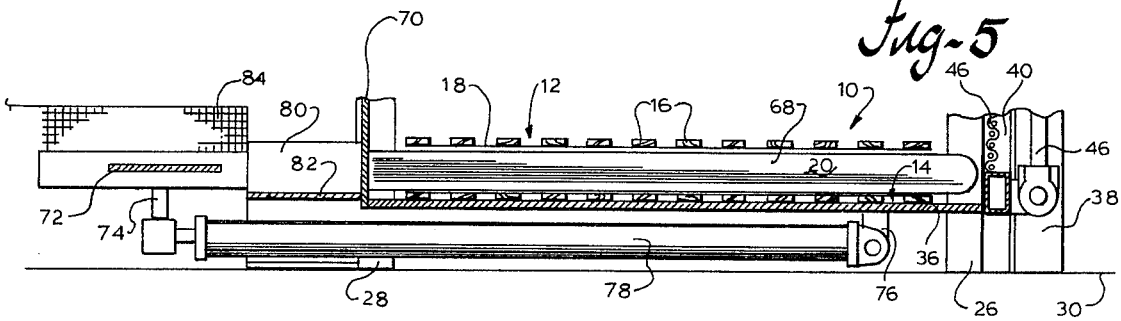
FIG. 5 is a side section view taken substantially on line 5—5 of FIG. 4.
Figure 3:
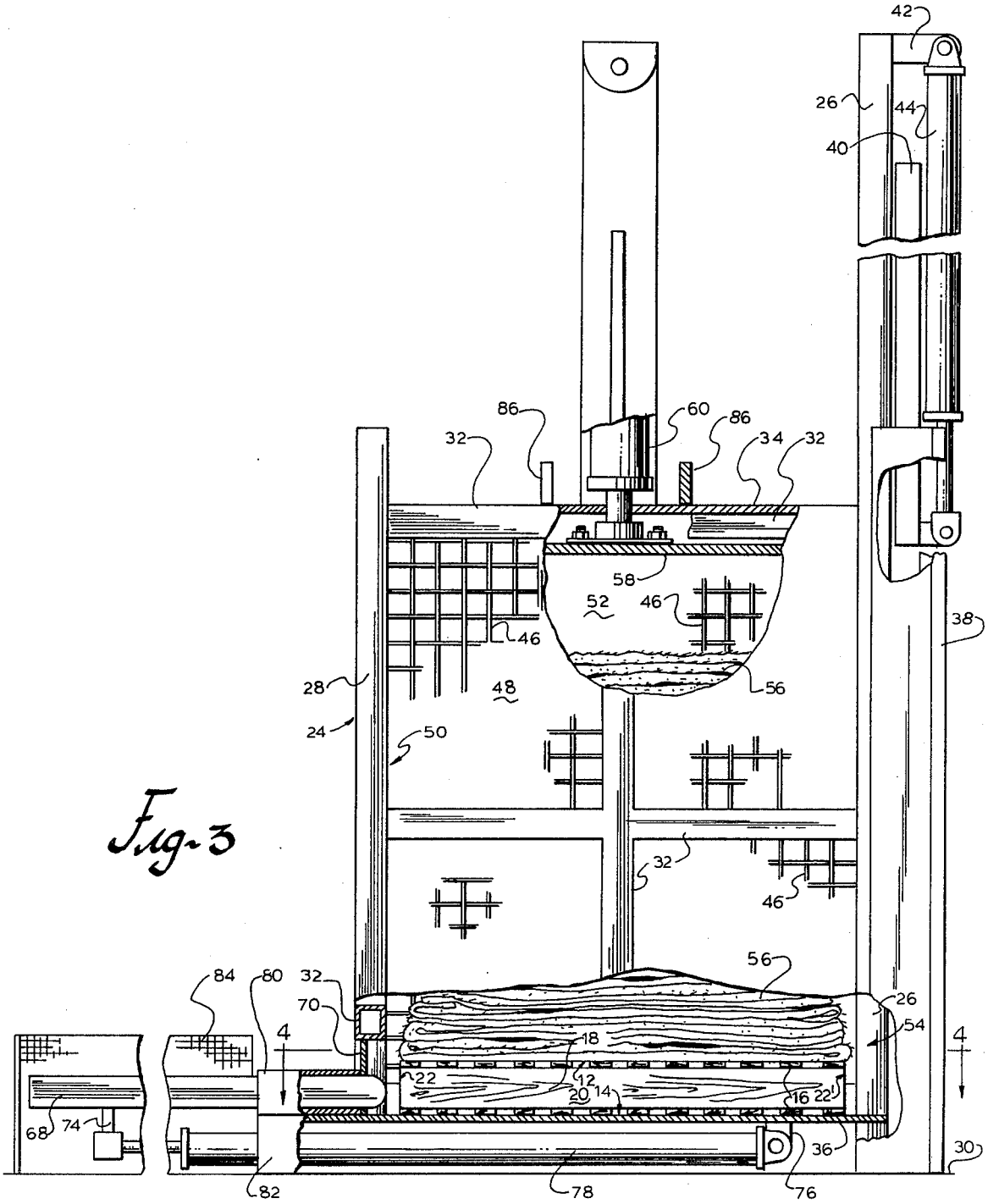
FIG. 3 is a side view of a hide press according to my invention with cutouts to reveal internal details.

FIGS. 3, 4, and 5 disclose an embodiment of a hide press according to my invention. Frame 24 of the hide press includes vertical stanchions 26 and 28 on floor 30. The stanchions 26 and 28 are connected by braces 32 welded therebetween.

Horizontal trapezoidal top and bottom plates 34 and 36, respectively, are welded between the stanchions 26 and 28 and to some of the braces 32. The stanchions 26 are located at the corners of the plates 34 and 36 defining acute angles, while the stanchions 28 are located at the corners of the plates 34 and 36 defining obtuse angles, as shown in FIG. 4.

Vertical gate guides 38 are welded to the stanchions 26. Gate 40 vertically slides between the gate guides 38 and the stanchions 26. Gate stand 42 extends between the stanchions 26 above the gate 40. Hydraulic gate cylinder 44 connects the gate stand 42 and the gate 40, such that the bottom of the gate 40 may be hydraulically raised to an elevation even with the top plate 34. (FIG. 3.)

Woven wire mesh 46 covers the gate 40 and three vertical sides framed by the stanchions 26 and 28 and the edges of the plate 34 and 36 opposite and adjacent to the gate 40. Sides 48, adjacent to and extending from the gate 40 to side 50 opposite the gate 40, are tapered, as shown in FIG. 4. When the gate 40 is lowered, box-like tapered container 52 with four vertical flat sides and a trapezoidal horizontal cross-section is formed. When the gate 40 is raised, a container opening or gateway 54 in the tapered container 52 is created. Hides 56 on the pallet 10 are loaded and unloaded onto the bottom plate 36 within the container 52 through the gateway 54.

Press means in the form of flat horizontal platen 58 connected to the top plate 34 by vertical hydraulic press cylinder 60 provides for compressing the wet hides between the pallet top 12 and the platen 58 when the press cylinder 60 is extended. As the wet hides 56 on the pallet 10 are compressed by the downward movement of the platen 58, excess water and other liquids will be forced from the hides. The draining of the liquids from the hides 56 is facilitated by the relatively large openings in the woven wire mesh 46. As the hides 56 are compressed, they will also be mashed against the woven wire mesh 46. The wire mesh 46 and braces 32 are sufficiently strong to resist this pressure, and form the hides 56 into a compressed hide bundle 62 having flat vertical sides 64. The flat platen 52 will also form a flat top 66 of the hide bundle 62.

As the wet hides 56 are compressed, they may partially protrude into the openings of the wire mesh 46, and wedge the hide bundle 62 in the container 52. The tapered sides 48 facilitate withdrawal of the hide bundle 62, because the width of the container 52 increases as the bundle 62 is withdrawn, thereby relieving the wedging problem.

During the compression of the hides 56 on the pallet 10, the pallet top 12 is subjected to the substantial pressure exerted on the hides 56 by the platen 58. Ordinarily, the slats 16 would deflect downward between the runners 18, and in some cases break, thereby damaging the pallet 10. Therefore, rigid, elongated fillers 68 are horizontally, slidably mounted on the frame 24 to be extended through the pallet side openings 22 into the pallet voids 20. During compression of the hides 56, the slats 16 in the pallet top 12 will press down on the filler 68. The filler 68 will in turn press down on the slats 16 in the pallet bottom 14. The pallet bottom 14 will be pressed against the bottom plate 36. The fillers 68 are preferably square steel tubing having a vertical thickness slightly less than the thickness of the runners 18 or of the void 20 from the pallet top 12 to the pallet bottom 14. The small difference in thickness between the filler 68 and the void 20 allows for clearance of the filler 68 during its insertion into the void 20. The small deflection of the slats 16 in the pallet top 12 against the fillers 68 during compression of the hides 56 will not damage the slats 16. The ends of the fillers 68 are preferably rounded or slanted to facilitate their insertion with the voids 20.

Vertical filler plate 70 extends between the stanchions 28 and is welded thereto. The plate 70 is welded to and extends up from the bottom plate 36. Connector plate 72 extends between and connects the ends of the fillers 68 distal of the filler plate 70. Peg 74 depends from the connector plate 72. Ear 76 depends from the base plate 36. Hydraulic filler cylinder 78 connects the peg 74 and the ear 76. When the filler cylinder 78 is retracted, the fillers 68 are extended through holes in the filler plate 70 into the pallet side openings 22, within the voids 20, and through the pallet side openings 22'.

Horizontal filler guides 80 in the form of square tubes welded to guide stand 82 have the openings at the ends of the guides 80 aligned with the holes in the filler plate 70. The guide stand 82 is welded to the filler plate 70 and the stanchions 28. The fillers 68 slide within the guides 80. The filler guides 80 keep the fillers 68 horizontal during their insertion into and retraction from the pallet 10. For safety, I prefer to extend a protective screen or filler guard 84 over the fillers 68.

Because of the great force exerted on the top plate during operation of the press cylinder 50 and platen 58, reinforcing plates 86 are welded to the top plate 34 and braces 32.

The preparation of hides for shipping may be seen to occur as follows. Wet hides are stacked on the pallet 10 as with the prior art, except that more hides are stacked on the pallet 10. Instead of allowing for a substantial drying time, the pallets 10 are transported by forklift truck 88, shown in FIG. 6, to the hide press. The pallet 10 with wet hides 56 thereon is placed on the bottom plate 36 within the hide press. The angled faces of the gate guides 38 help to guide the pallet 10 and hides 56 within the container 52. Forks 90 of the forklift are withdrawn from the voids 20 through the side openings 22'. FIG. 3 shows the pallet and hides within the hide press with the gate 40 up and fillers 68 retracted. The gate cylinder 44 is extended to lower the gate 40 to the closed position. The filler cylinder 78 is retracted to extend the fillers 68 through the side openings 22, within the voids 20, and through the side openings 22', as shown in FIGS. 4 and 5.

The press cylinder 60 is extended to press the platen 58 against the top of the hides 56, thereby compressing the hides between the platen 58 and the pallet top 12. The press cylinder 50 compresses the hides 56 until a selected pressure is reached, then maintains the selected pressure for a desired compression period. During compression of the hides 56, excess liquid will drain from the hides 56 through the wire mesh 46. The flat vertical sides 48 and 50, gate 40, and the flat platen 58 will form the hides 56 into the compressed hide bundle 62 having the flat sides 64 and the flat top 66. The compressed hides will occupy less volume, thereby permitting the stacking of the additional hides 56 on each pallet 10 as described previously.

The press cylinder 60 is retracted after the compression period to raise the platen 58. The filler cylinder 78 is extended to retract the fillers 68 from the voids 20. The gate cylinder 44 is retracted to raise the gate 40. The forklift forks are inserted through the side openings 22' into the voids 20, and the pallet 10 with compacted hide bundle 62 thereon raised and withdrawn from the hide press container 52.

As opposed to the prior art, the hide bundles 62 on the pallet 10 need not be banded prior to shipment or storage. The compacted hides 56 are sufficiently cohesive that they will substantially maintain their compact shape during shipment.

Figure 6:
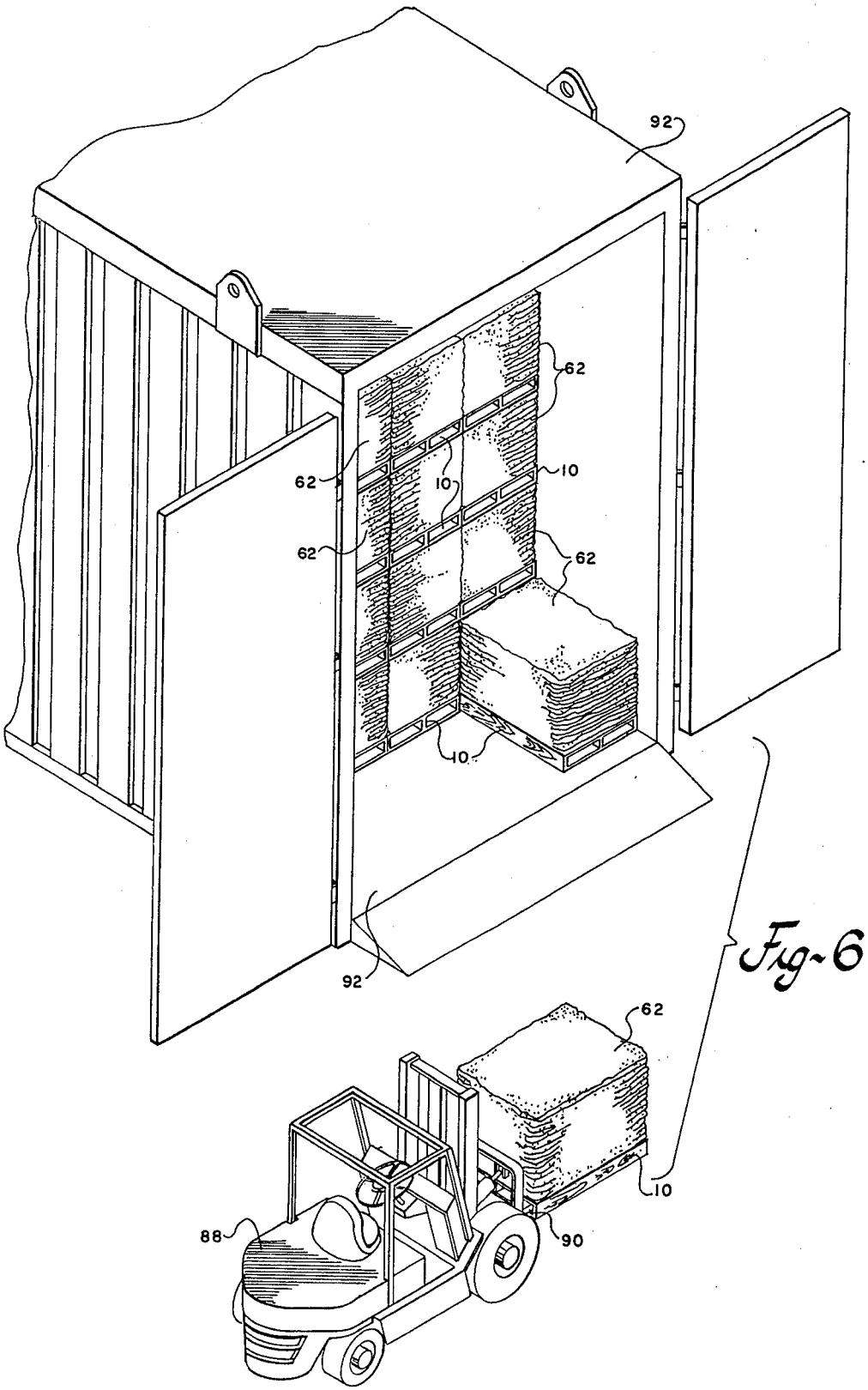
FIG. 6 is a perspective view of the hide bundles on pallets being stacked in a shipping container.

The forklift truck transports the pallet 10 with the hide bundle 62 thereon shipping container 92, shown in FIG. 6 for immediate packing, or to a warehouse area (not shown) for storage prior to packing for shipment. In either case, space is saved because the pallets 10 with hide bundles 62 thereon may be stacked three or more high as opposed to the limit in the prior art pallets to stacks of two high. Additionally, because the hide bundles 62 are uniform, and have flat sides, they may be more closely packed within the shipping container or storage area.

Those with ordinary skill in the machine construction art will understand that automatic sequence switches, hydraulic pumps, hoses, connections, valves, pressure switches, time delay switches and the like have not been shown, inasmuch as these elements are all conventional and are within the skill of those having ordinary skill in the construction of machinery that includes hydraulic cylinders.

The embodiment shown and described above is only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. A press including materials handling pallet having a. a top adapted to hold materials thereon, b. a bottom, and c. spacer structure between the top and bottom creating d. at least one void between the top and bottom, e. the void being accessible through opposing side openings in the pallet between the top and bottom;

wherein the improved structure for compressimg materials on said pallet comprises:

f. a frame, g. vertical press means on the frame for forcibly compressing the materials against the top of the pallet, and h. at least one filler on the frame removably extended through one of the side openings between the top and bottom into said void, i. each filler providing means for limiting downward deflection of the top during the compression of the materials against said top.

2. The invention as defined in claim 1 including all of the limitations a. through i. with the addition of the following limitation:

j. at least one of said fillers extending from one of the side openings through the void to the opposite side opening.

3. The invention as defined in claim 2 including all of the limitations a. through j. with the addition of the following limitation:

k. the fillers being regularly spaced between the spacer structures.

4. The invention as defined in claim 1 including all of the limitations a. through i., wherein the pallet top and bottom are substantially flat and parallel, and the spacer structure includes at least two elongated, spaced apart, parallel runners connecting the top and bottom, with the additional limitation of:

j. each of said fillers being an elongated, rigid member having a vertical thickness slightly less than the runner thickness.

5. The invention as defined in claim 1 including all of the limitations a. through i. with the addition of the following limitation:

j. the height of each filler slightly less than the distance between the top and bottom.

6. The invention as defined in claim 1 including all of the limitations a. through i. with the addition of the following limitations:

j. a container having four sides on the frame for keeping the materials within a desired space above the pallet during the compressing of the materials, k. one of the sides being movable to expose an opening in the container through which the pallet and materials may be inserted and removed.

7. The invention as defined in claim 7 including all of the limitations a. through k. with the addition of the following limitation:

l. the container being tapered to facilitate removal of the pallet with compressed materials thereon.

8. The invention as defined in claim 7 including all of the limitations a. through l., wherein the pallet top and bottom are substantially flat and parallel, and the spacer structure includes at least two elongated, spaced apart, parallel runners connecting the top and bottom, with the additional limitation of:

m. each of said fillers being an elongated, rigid member having a vertical thickness slightly less than the runner thickness.

9. The invention as defined in claim 8 including all of the limitations a. through m. with the addition of the following limitation:

n. at least one of said fillers extending from one of the side openings through the void to the opposite side opening.

10. The invention as defined in claim 9 including all of the limitations a. through n. with the addition of the following limitation:

o. the fillers being regularly spaced between the runners.

11. A press including hide handling pallet having a. at least two straight, elongated, spaced-apart, parallel, runners, b. a plurality of straight, elongated, spaced-apart, parallel, slats connected on opposite sides and perpendicular to said runners forming a top and bottom, c. the runners and slats forming at least one void therebetween having side openings at the ends of the runners, wherein the improved structure for compressing materials on said pallet comprises:

d. a frame having connected thereto e. a base plate on which the pallet with hides thereon rests, f. a platen above said hides, g. a hydraulic cylinder connecting the frame and platen for compressing the pallet and hides between the base plate and platen, h. elongated, rigid fillers extended through one of the side openings between the top and bottom within the void, i. the height of each of the fillers being slightly less than the distance between top and bottom, j. a container having four sides on the frame for keeping the materials within a desired space above the pallet during the compressing of the materials, k. one of the sides being movable to expose an opening in the container through which the pallet and materials may be inserted and removed, l. the container being tapered to facilitate removal of the pallet with compressed materials thereon.

12. The invention as defined in claim 11 including all of the limitations a. through l. with the addition of the following limitations:

m. the container sides on the frame being formed by woven wire mesh, n. four of the parallel fillers spaced horizontally apart by o. a connector plate extending between and connecting the ends of the fillers distal of the base plate, p. a peg depending from the connector plate, q. an ear depending from the base plate, r. a hydraulic cylinder below the base plate connecting the ear and the peg providing means for inserting and withdrawing the filler into and out of the voids, s. the movable side being vertically slidably connected to the frame by t. vertical gate guides on the frame adjacent the opening in the container, u. a gate stand on the frame extending above the container opening and the gate guides, v. a hydraulic cylinder connecting the gate stand and the gate for raising and lowering the gate, and w. two of the sides of the container being tapered from the container opening to the side opposite the container opening.

13. The process involving pallets having:

a. a top adapted to hold animal hides, b. a flat bottom, c. at least one void between the top and bottom that is accessible through at least one side opening therebetween, wherein the improved method of shipping animal hides comprising the steps of:

d. stacking wet hides on one of the pallets, e. placing the pallet with the wet hides within a container having vertical sides, a flat bottom plate, and flat top plate, f. compressing the hides on the pallet by g. pressing the pallet and hides between the bottom and top plates within the vertical sides until a selected pressure on the hides is obtained, h. maintaining the selected pressure for a desired period, thereby i. squeezing liquids from the wet hides, ii. compacting the hides into cohesive bundles, thus j. forming bundles of hides on the pallets with flat vertical sides and flat tops, k. removing the pallets with the dryed, compacted, formed hide bundles thereon from the container, l. stacking the pallets and hide bundles on top and close beside one another for shipment.

14. The invention as defined in claim 13 including all of the limitations a. through l. with the addition of the following limitations:

m. inserting at least one filler through the side opening and within the void prior to and during the forcing and maintaining steps, thereby n. limiting deflection of the pallet top, and o. preventing damage to the pallet, during the forcing and maintaining steps.

15. The process of preparing and shipping hides comprising:

a. stacking wet hides on a pallet, b. compressing the hides on the pallet while forming the hides into a bundle having flat, vertical sides and a flat top, and c. stacking the pallets with hide bundles thereon at least three high within a shipping container.

* * * * *